United States Patent [19]

Scapellati

[11] 4,169,532

[45] Oct. 2, 1979

[54] PARTS TRAY

[76] Inventor: Umberto Scapellati, 199 Grand Blvd., Deer Park, N.Y. 11729

[21] Appl. No.: 911,358

[22] Filed: Jun. 1, 1978

[51] Int. Cl.[2] ..... B65D 1/36

[52] U.S. Cl. ..... 206/557; 206/561; 206/818; 224/48 R

[58] Field of Search ..... 206/557, 561, 564, 818; 224/42.42 R, 48 R, 29 R

[56] References Cited

U.S. PATENT DOCUMENTS

| | | | |
|---|---|---|---|
| 3,223,281 | 12/1965 | Larkin | 224/42.42 R |
| 3,245,522 | 4/1966 | Pearson | 224/29 R |
| 3,331,494 | 7/1967 | Gregg, Jr. | 224/42.42 R |
| 3,670,938 | 6/1972 | Brocato | 224/48 R |

*Primary Examiner*—William T. Dixson, Jr.
*Attorney, Agent, or Firm*—Richard L. Miller

[57] ABSTRACT

A portable tray for holding parts and components while fixing or disassembling any mechanical or electrical equipment; the tray being molded of plastic and including a well with a magnetic plate on its bottom for magnetically holding small steel parts. The tray also includes a non-magnetic trough for receiving parts. The tray includes a removable sand bag on its underside for holding the tray upon sloping surfaces, and also a removable screen dish placable over the top of the magnetic well.

3 Claims, 5 Drawing Figures

PARTS TRAY

This invention relates generally to trays used for temporarily holding assorted small parts and components.

A principal object of the present invention is to provide a portable tray that is versatile in uses in order to accomodate itself for different locations.

Another object is to provide a tray that includes a well for magnetically holding small steel parts placed therein, and which also includes a non-magnetic trough for simply receiving parts.

Yet another object is to provide a tray which includes a removable sand bag on its underside so to support the tray horizontally level on an inclined surface, or frictionally retaining it upon any inclined, very smooth surface such as upon a contoured body of an automotive vehicle.

Yet another object is to provide a tray which includes a removable screen dish that fits over the top of the well, so to hold parts while being immerged in a liquid for washing.

Yet a further object is to provide a tray that can be made in different sizes so to be used in a home, or factory, and which would be ideal for a garage mechanic, a watch maker or other tradesman working with parts.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
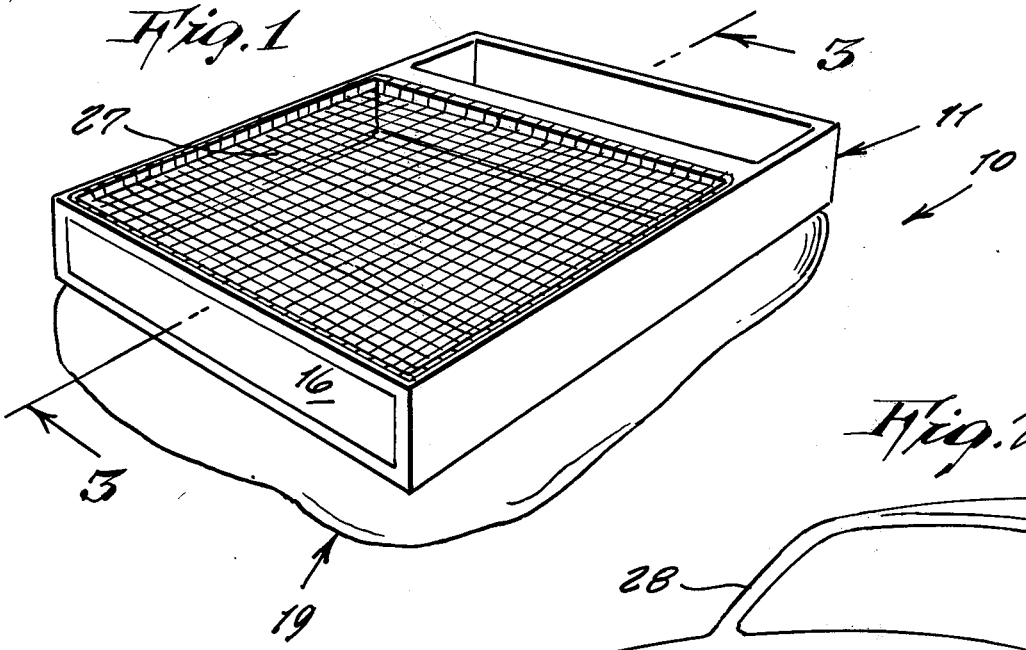
FIG. 1 is a perspective view of the invention assembled together with a removable screen.
Figure 2:
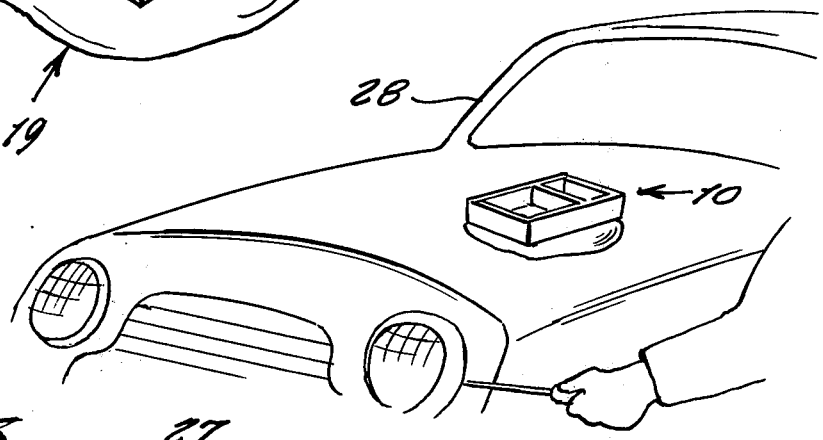
FIG. 2 shows the invention in use without the screen.

Referring now to the drawing in greater detail, the reference numeral 10 represents a parts tray according to the present invention, wherein there is a tray member 11 molded of a plastic material, and which is shaped so to include a large well 12 and a long, narrow trough 13, separated by a partition 14. A bottom wall of the well is lined with a magnetic, flat plate 15.

One end wall 16 of the well is snap fitted therein for easy removal if so wishes.

The tray may be made in any size so to serve various specific purposes or trades, but a preferred size for general use, measures 7 by 7 inches, and 3 inches high.

The partition is positioned so that the trough is one inch wide.

The underside of the tray member 11 is molded with a downward extending lip 17 all around, and the outer side of the lip has an inward groove 18. A removable sand bag 19 encloses the lower end of the lip and is secured to the tray member by a peripheral edge 20 thereof snap-fitting into the groove 18.

The sand bag is made to include an upper and lower layer of fabric 21 between which a quantity of loose sand 22 is contained. The peripheral edge is rolled over to include a longitudinal slot 23 in which there is an elastic cord 24 for gathering the edge and thus snap fit into the groove 18.

A space 25 formed between the sand bag and a bottom wall 26 of the tray member allows the bag to be upwardly flexed thereinto in order to conform to a contour of any curved or irregular shaped object upon which the tray is placed.

A screen dish 27 snap fits into an upper end of the well, and is made of a wire mesh.

Figure 3:
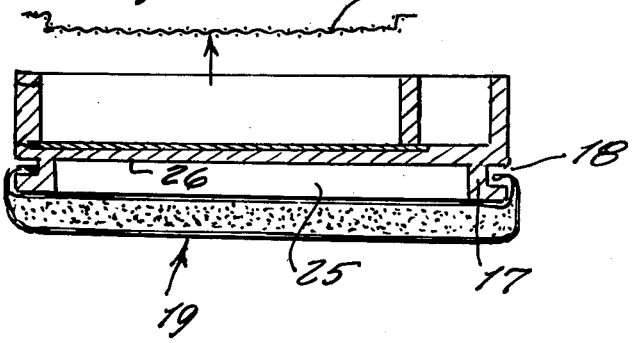
FIG. 3 is a cross section on line 3—3 of FIG. 1.
Figure 4:
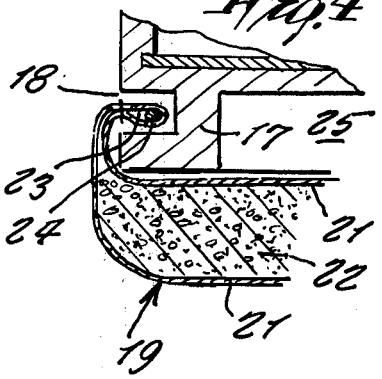
FIG. 4 is an enlarged detail of FIG. 3.
Figure 5:
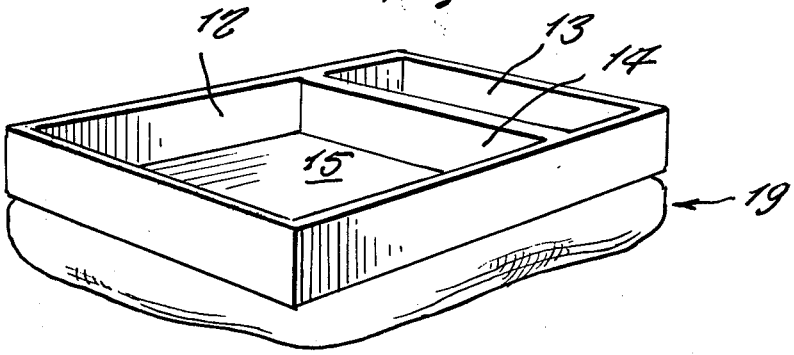
FIG. 5 is a perspective view of the device with screen removed.

In operative use, as shown in FIG. 3, the tray sand bag allows the tray to rest securely on a horizontally level position on a smooth surfaced, round hood of a car 28, or the like, as one example. Magnetic granules may be added to the sand for additional frictional hold. The removable dish allows supporting parts while immerged in a bath. The plastic material of the tray member may be made in any attractive color.

While certain novel features of this invention have been shown and described and are pointed out in the annxed claims, it will be understood that various omissions, substitutions and changes in the forms and details of the device illustrated and in its operation can be made by those skilled in the art without departing from the spirit of the invention.

I claim:

1. A portable tray, comprising in combination, a tray member of molded plastic having a well and narrow trough formed thereupon by a partition therebetween, a removeable screen dish placed on a top of a said well, and a removeable sand bag positioned directly beneath an underside of said tray member; said well including a magnetic plate at a bottom thereof; said screen dish being made of a wire mesh; and said removeable sand bag having magnetic granules added to a sand thereof.

2. The combination as set forth in claim 1 wherein a lower end of said tray member includes a downwardly extending lip having a groove around an outer side thereof for securement of said sand bag therein.

3. The combination as set forth in claim 2 wherein said sand bag includes a quantity of loose sand in a pocket formed between an upper and lower layer of fabric, a peripheral edge of said fabric being rolled over to form a slot containing an elastic cord for gathering said edge and snap fitting in said lip groove.

* * * * *